US007263956B2

(12) United States Patent
Spath et al.

(10) Patent No.: US 7,263,956 B2
(45) Date of Patent: Sep. 4, 2007

(54) VALVE LIFTER ASSEMBLY FOR SELECTIVELY DEACTIVATING A CYLINDER

(75) Inventors: Mark J. Spath, Spencerport, NY (US); Nick J. Hendriksma, Grand Rapids, MI (US); Michael J. Fox, Stafford, NY (US)

(73) Assignee: Delphi Technologies, Inc., Troy, MI (US)

( * ) Notice: Subject to any disclaimer, the term of this patent is extended or adjusted under 35 U.S.C. 154(b) by 537 days.

(21) Appl. No.: 10/305,311

(22) Filed: Nov. 26, 2002

(65) Prior Publication Data

US 2003/0075129 A1 Apr. 24, 2003

Related U.S. Application Data

(63) Continuation-in-part of application No. 09/693,452, filed on Oct. 20, 2002, now Pat. No. 6,513,470, which is a continuation-in-part of application No. 10/229,350, filed on Aug. 26, 2002, now Pat. No. 6,578,535, which is a continuation-in-part of application No. 09/840,375, filed on Apr. 23, 2001, now Pat. No. 6,497,207, which is a continuation-in-part of application No. 09/607,071, filed on Jun. 29, 2000, now abandoned.

(60) Provisional application No. 60/141,985, filed on Jul. 1, 1999.

(51) Int. Cl.
*F01L 1/34* (2006.01)
*F01L 1/14* (2006.01)
*F01L 1/16* (2006.01)
*F01L 1/18* (2006.01)

(52) U.S. Cl. ..... 123/90.16; 123/90.15; 123/90.48; 123/90.49; 123/90.5; 123/90.52; 123/90.39; 29/592; 74/569

(58) Field of Classification Search ..... 123/90.16, 123/90.15, 90.48, 90.49, 90.5, 90.55, 198 F, 123/90.52, 90.39; 29/592; 74/569
See application file for complete search history.

(56) References Cited

U.S. PATENT DOCUMENTS 3,108,580 A 10/1963 Crane (Continued)

*Primary Examiner*—Henry Bennett
*Assistant Examiner*—Nihir Patel
(74) *Attorney, Agent, or Firm*—Paul L. Marshall

(57) ABSTRACT

A valve lifter assembly for deactivating a cylinder in an internal combustion engine. The valve lifter assembly is provided with a plunger movably disposed within a bore of a main body member to controllably isolate the cam lift from the rocker arm and valve of the engine. The plunger is normally locked in an extended position to transmit cam lift to reciprocatingly operate the valve. At least one locking pin is moveably disposed within the plunger to engage an inner annular groove of the main body member. Pressurized oil is provided to dislodge the locking pins from the annular groove and allow the plunger to move within the main body member, thereby isolating the cam lift from the rocker arm and valve. The deactivating lifter is preferably disposed within the recess conventionally provided for hydraulic valve lifters.

8 Claims, 6 Drawing Sheets

U.S. PATENT DOCUMENTS

| | | | | | |
|---|---|---|---|---|---|
| 3,886,808 | A | | 6/1975 | Weber | |
| 4,054,109 | A | | 10/1977 | Herrin et al. | |
| 4,083,334 | A | | 4/1978 | Roncon | |
| 4,089,234 | A | | 5/1978 | Henson et al. | |
| 4,098,240 | A | | 7/1978 | Abell, Jr. | |
| 4,133,332 | A | | 1/1979 | Benson et al. | |
| 4,164,917 | A | | 8/1979 | Glasson | |
| 4,207,775 | A | | 6/1980 | Lintott | |
| 4,228,771 | A | | 10/1980 | Krieg | |
| 4,231,267 | A | | 11/1980 | Van Slooten | |
| 4,463,714 | A | | 8/1984 | Nakamura | |
| 4,546,734 | A | * | 10/1985 | Kodama | 123/90.16 |
| 4,615,307 | A | * | 10/1986 | Kodama et al. | 123/90.16 |
| 4,739,675 | A | | 4/1988 | Connell | |
| 4,790,274 | A | * | 12/1988 | Inoue et al. | 123/198 F |
| 4,905,639 | A | * | 3/1990 | Konno | 123/90.16 |
| 4,913,106 | A | | 4/1990 | Rhoads | |
| 4,941,438 | A | | 7/1990 | Muto | |
| 4,942,855 | A | | 7/1990 | Muto | |
| 5,085,182 | A | * | 2/1992 | Nakamura et al. | 123/90.16 |
| 5,088,455 | A | | 2/1992 | Moretz | |
| 5,090,364 | A | | 2/1992 | McCarroll et al. | |
| 5,099,806 | A | * | 3/1992 | Murata et al. | 123/90.16 |
| 5,245,958 | A | | 9/1993 | Krieg et al. | |
| 5,247,913 | A | * | 9/1993 | Manolis | 123/90.16 |
| 5,253,621 | A | | 10/1993 | Dopson et al. | |
| 5,255,639 | A | | 10/1993 | Shirey et al. | |
| 5,261,361 | A | * | 11/1993 | Speil | 123/90.22 |
| 5,307,769 | A | | 5/1994 | Meagher et al. | |
| 5,345,904 | A | * | 9/1994 | Dopson et al. | 123/198 F |
| 5,351,662 | A | * | 10/1994 | Dopson et al. | 123/90.16 |
| 5,357,916 | A | * | 10/1994 | Matterazzo | 123/90.16 |
| 5,361,733 | A | * | 11/1994 | Spath et al. | 123/90.16 |
| 5,386,806 | A | * | 2/1995 | Hurr et al. | 123/90.16 |
| 5,398,648 | A | | 3/1995 | Spath et al. | |
| 5,402,756 | A | * | 4/1995 | Bohme et al. | 123/90.16 |
| 5,419,290 | A | * | 5/1995 | Hurr et al. | 123/90.16 |
| 5,429,079 | A | * | 7/1995 | Murata et al. | 123/90.16 |
| 5,431,133 | A | * | 7/1995 | Spath et al. | 123/90.16 |
| 5,501,186 | A | * | 3/1996 | Hara et al. | 123/90.16 |
| 5,544,626 | A | | 8/1996 | Diggs et al. | |
| 5,544,628 | A | | 8/1996 | Voigt | |
| 5,546,899 | A | | 8/1996 | Sperling et al. | |
| 5,555,861 | A | * | 9/1996 | Mayr et al. | 123/90.16 |
| 5,615,651 | A | * | 4/1997 | Miyachi | 123/198 F |
| 5,651,335 | A | * | 7/1997 | Elendt et al. | 123/90.16 |
| 5,655,487 | A | * | 8/1997 | Maas et al. | 123/90.16 |
| 5,660,153 | A | | 8/1997 | Hampton et al. | |
| 5,669,342 | A | * | 9/1997 | Speil | 123/90.16 |
| 5,682,848 | A | | 11/1997 | Hampton et al. | |
| 5,709,180 | A | | 1/1998 | Spath | |
| 5,720,244 | A | * | 2/1998 | Faria | 123/90.16 |
| 5,782,216 | A | * | 7/1998 | Haas et al. | 123/90.16 |
| 5,803,040 | A | | 9/1998 | Biesinger et al. | |
| 5,832,884 | A | * | 11/1998 | Haas et al. | 123/90.16 |
| 5,875,748 | A | * | 3/1999 | Haas et al. | 123/90.16 |
| 5,893,344 | A | | 4/1999 | Church | |
| 5,934,232 | A | | 8/1999 | Greene et al. | |
| 6,032,643 | A | * | 3/2000 | Hosaka et al. | 123/321 |
| 6,053,133 | A | * | 4/2000 | Faria et al. | 123/90.16 |
| 6,092,497 | A | | 7/2000 | Preston et al. | |
| 6,095,696 | A | | 8/2000 | Foldi | |
| 6,164,255 | A | * | 12/2000 | Maas et al. | 123/90.16 |
| 6,196,175 | B1 | * | 3/2001 | Church | 123/90.16 |
| 6,213,076 | B1 | * | 4/2001 | Fischer et al. | 123/90.55 |
| 6,244,229 | B1 | * | 6/2001 | Nakano et al. | 123/90.15 |
| 6,247,433 | B1 | | 6/2001 | Faria et al. | |
| 6,257,185 | B1 | | 7/2001 | Groh et al. | |
| 6,273,039 | B1 | | 8/2001 | Church | |
| 6,318,324 | B1 | | 11/2001 | Koeroghlian et al. | |
| 6,321,704 | B1 | | 11/2001 | Church et al. | |
| 6,321,705 | B1 | | 11/2001 | Fernandez et al. | |
| 6,325,030 | B1 | | 12/2001 | Spath et al. | |
| 6,345,596 | B1 | | 2/2002 | Kuhl | |
| 6,405,699 | B1 | | 6/2002 | Church | |
| 6,412,460 | B1 | * | 7/2002 | Sato et al. | 123/90.16 |
| 6,427,652 | B2 | | 8/2002 | Faria et al. | |
| 6,439,176 | B1 | | 8/2002 | Payne et al. | |
| 6,460,499 | B1 | | 10/2002 | Mason et al. | |
| 6,477,997 | B1 | * | 11/2002 | Wakeman | 123/90.16 |
| 6,497,207 | B2 | | 12/2002 | Spath et al. | |
| 6,513,470 | B1 | | 2/2003 | Hendriksma et al. | |
| 6,578,535 | B2 | | 6/2003 | Spath et al. | |
| 6,588,394 | B2 | | 7/2003 | Zheng | |
| 6,591,796 | B1 | | 7/2003 | Scott | |
| 6,595,174 | B2 | | 7/2003 | Schnell | |
| 6,606,972 | B2 | | 8/2003 | Wenisch et al. | |
| 6,615,783 | B2 | | 9/2003 | Haas et al. | |
| 6,668,776 | B2 | | 12/2003 | Hendriksma et al. | |
| 6,745,737 | B2 | | 6/2004 | Evans et al. | |
| 6,866,014 | B2 | | 3/2005 | Spath | |
| 2002/0038642 | A1 | | 4/2002 | Haas et al. | |
| 2003/0070636 | A1 | | 4/2003 | Evans et al. | |
| 2003/0101953 | A1 | | 6/2003 | Hendriksma et al. | |

FOREIGN PATENT DOCUMENTS

| | | |
|---|---|---|
| DE | 198 04 952 | 8/1999 |
| WO | 03/067038 A1 | 1/2003 |

OTHER PUBLICATIONS

Buuck, Bryce, et al., "Engine Trends and Valve Train Systems for Improved Performance and Fuel Economy", Eaton Corporation - Engine Components Operations, USA, pp. 1-9 (Aug. 1999).

Fortnagel, Manfred, et al., "Four Made of Eight - The New 4.31 and 5.01 V8 Engines", Mercedes-Benz S-Class, pp. 58-62 (1997).

Sandford, Malcolm H., et al., "Reduced Fuel Consumption & Emissions Through Cylinder Deactivation", Aachener Kolloquium Fahzeug-und Motorentechnik, pp. 1017-1027 (1998).

Chrysler Group, "Design Practice Standards", Paper dated Mar. 15, 2005, 1 page, in German, with English translation (2 pages).

* cited by examiner

VALVE LIFTER ASSEMBLY FOR SELECTIVELY DEACTIVATING A CYLINDER

RELATIONSHIP TO OTHER APPLICATIONS

This application is a continuation-in-part of U.S. patent application Ser. No. 09/693,452, filed Oct. 20, 2000; which is a continuation-in-part of U.S. patent application Ser. No. 09/607,071, filed Jun. 29, 2000 which claims the benefit of U.S. provisional application 60/141,985, filed on Jul. 1, 1999.

This application is also a continuation-in-part of U.S. application Ser. No. 09/840,375, filed Apr. 23, 2001, which is a continuation-in-part of U.S. patent application Ser. No. 09/693,452, filed Oct. 20, 2000.

This application is also a continuation-in-part of U.S. application Ser. No. 10/229,350, filed Aug. 26, 2002, which is a continuation-in-part of U.S. application Ser. No. 09/840,375, filed Apr. 23, 2001, which is a continuation-in-part of U.S. patent application Ser. No. 09/693,452, filed Oct. 20, 2000, which is a continuation-in-part of U.S. patent application Ser. No. 09/607,071, filed Jun. 29, 2000 which claims the benefit of U.S. provisional application 60/141,985, filed on Jul. 1, 1999.

TECHNICAL FIELD

The present invention is directed to valve lifters and more particularly directed to a valve lifter assembly for selectively deactivating a cylinder in an internal combustion engine.

BACKGROUND OF THE INVENTION

Selective deactivation of cylinders in multiple cylinder internal combustion engines is known in the art. For example, it is known in eight cylinder engines to selectively deactivate two or more cylinders during light load conditions. Such deactivation of cylinders can therefore increase fuel efficiency. Various devices are known in the art to deactivate valves for improving fuel efficiency during specific engine load conditions.

Older systems have proposed to deactivate cylinders by simply cutting off the supply of fuel to selective cylinders. However such systems suffer from the drawback that each deactivated cylinder continuously imports, compresses, and expels unignited air significantly reducing the efficiency of the engine. It was then suggested to selectively deactivate cylinders by deactivating the valve assembly to eliminate the continuous pumping by the deactivated cylinders. One such system proposed to cut off an entire bank of a six-cylinder engine and utilized an additional complicated mechanical device to hold open the exhaust valves to eliminate losses previously endured during the compression stroke. Other complicated mechanical valve drive solutions have also been suggested which heretofore have not provided a viable solution to cylinder deactivation.

It is also known to provide a roller hydraulic lifter valve between a cam and a rocker arm in a conventional cam in head driven valve assembly in an internal combustion engine. A hydraulic valve lifter is mounted to the head of the engine and disposed between the cam and the rocker arm. A source of pressurized oil is provided to the hydraulic lifter to provide zero lash adjustment and is conventional in the art. When the valve closes, oil flows into the tappet body to urge a lifter plunger to contact the valve train and take up any clearance. As the camshaft pushes on the lifter a check valve is closed to seal the oil inside the lifter. The lifter then acts as a solid unit. However, the prior art hydraulic lifters do not positively lock a plunger relative to the main body of the lifter and can not provide cylinder deactivation because there is no mechanism to free the plunger to absorb cam lift. Conventional, hydraulic valve lifters are provided for eliminating lash and can not provide deactivation.

Accordingly, it is an object of the present invention to provide a simple means to selectively deactivate valve operation of specific cylinders during certain engine load conditions. It is further desirable to provide a deactivation means which requires few changes to existing components and may be employed within the existing space occupied by conventional valve-train components.

SUMMARY OF THE INVENTION

The present invention is directed to a valve lifter assembly for deactivating a cylinder in an internal combustion engine. A lifter is provided between a cam and a rocker arm assembly in a conventional cam in head or pushrod engine. The valve lifter is provided with a plunger movably disposed within a bore of a main body of the lifter assembly to controllably isolate the cam lift from the rocker arm. The plunger is normally locked in an extended position to transmit rotational movement of the cam to the rocker arm to reciprocatingly operate the valve. One or more locking pins are moveably disposed within the plunger to engage a groove formed on the inner surface of the bore of the main body. Pressurized oil is provided in communication with the locking pins to dislodge the locking pins from the groove and allow the plunger to move within the bore. As the cam rotates, the plunger is forced deeper within the bore to decrease the overall length of the lifter assembly and isolate the cam from the rocker arm to deactivate valve operation. A spring is disposed between the plunger and main body of the lifter assembly to bias the plunger in the extended position. Such an arrangement is provided to ensure that there is some constant pressure exerted on the rocker arm and to maintain contact between the cam and follower in the deactivated state.

The locking pins preferably have a spring disposed there between to bias the pins outward to engage the grooves of the main body. A stop may be placed between the pins midway along the bore extending through the plunger to produce symmetrical retraction of the locking pins during deactivation.

The lifter of the present invention is preferably disposed within the existing space provided for conventional roller hydraulic valve lifters as hydraulic valve lifters are provided with a source of pressurized oil for lash adjustment.

The objects, features and advantages of the present invention are readily apparent from the following detailed description of the best modes for carrying out the invention when taken in connection with the accompanying drawings.

DETAILED DESCRIPTION OF PREFERRED EMBODIMENTS

Figure 1:
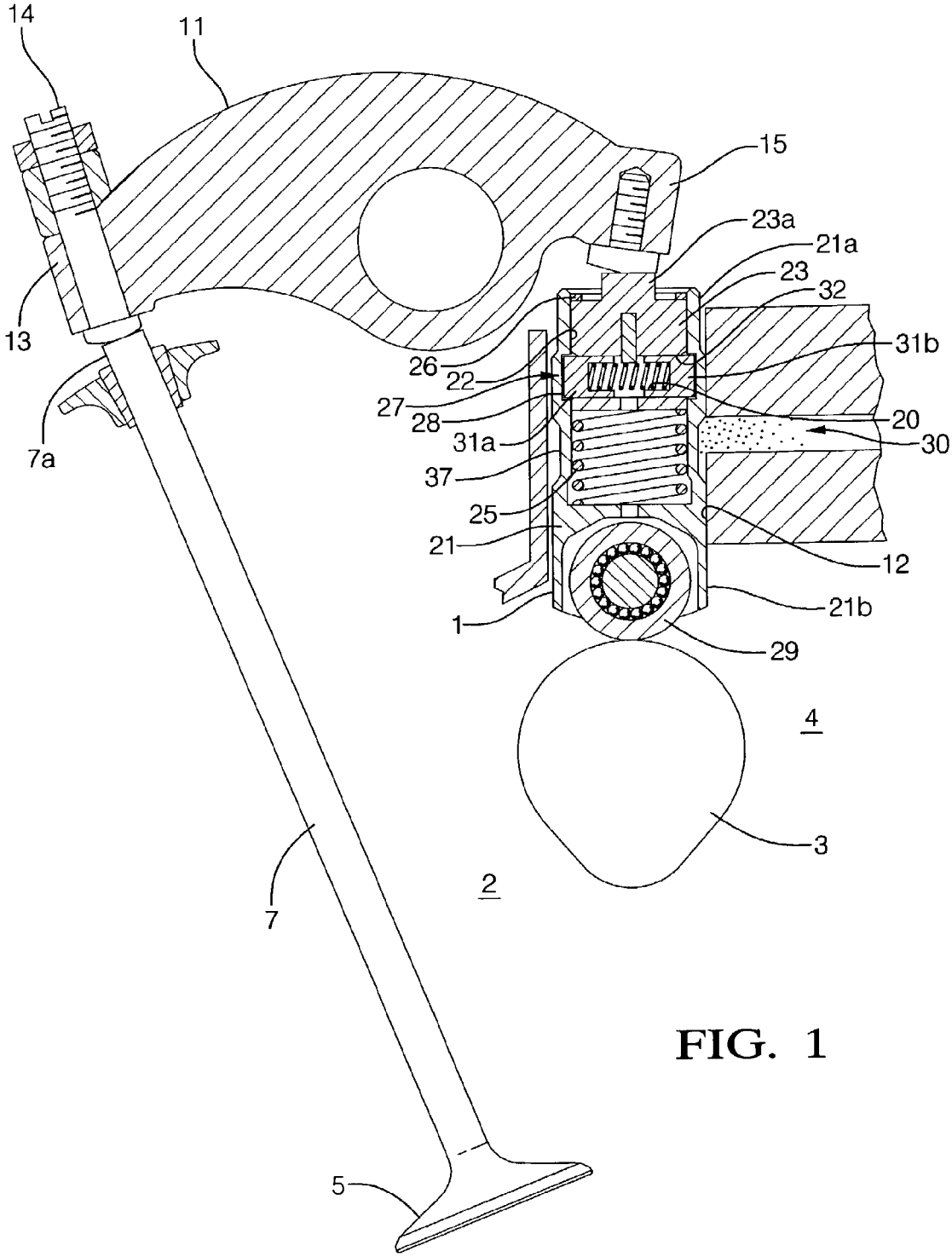
FIG. 1 is a sectional view of an over head cam valve train assembly in an internal engine employing the lifter of the present invention during normal operation with the valve in the closed position.

FIG. 1 is a cross sectional view of the valve lifter assembly 1 of the present invention in a cam in head arrangement in an internal combustion engine 2. A cam 3 of a camshaft is rotatably mounted within the head 4 of the engine as is commonly known in the art. A valve 5 having a valve stem 7 extends from cylinder head 4 toward the rocker arm 11 as is also commonly known in the art. A coiled spring (not shown) biases the valve stem 7 upward in the closed position. The rocker arm 11 is pivotally mounted within the head of the vehicle as is also commonly known in the art. A first end 13 of the rocker arm 11 engages a top portion 7*a* of the valve stem 7. A lash adjuster is also provided to adjust valve clearance. In the embodiment shown in FIG. 1, mechanical valve lifter assembly 1 is mounted within a bore 12 of the head of the engine between the cam 3 and a second end 15 of the rocker arm 11. As the cam 3 rotates the valve lifter assembly 1 is forced upwards to engage the second end 15 of the rocker arm 11 causing the rocker arm 11 to pivot and displace the first end 13 of the rocker arm 11 downward to open the valve. This basic arrangement is well known in the art. It is also known to provide a roller hydraulic valve lifter assembly between the cam 3 and rocker arm 11 to provide zero lash adjustment. The present invention is directed to the structure of the valve lifter assembly 1 and its use in deactivating the valve 5 in its respective cylinder.

The valve lifter assembly 1 of the present invention has a main body member 21. Preferably the main body member 21 is seated in a portion of the head of the engine conventionally suited for hydraulic valve lifters. The upper or first end of the valve lifter assembly is adapted to engage the second end 15 of the rocker arm 11. A plunger 23 is disposed within a bore 22 of the main body member 21 and has an exposed surface 23*a* of a first end 21*a* of said main body member 21 to engage the second end 15 of the rocker arm 11. A first coiled spring 25 is disposed in spring chamber 20 in bore 22 between the main body member 21 and the plunger 23 to bias the plunger 23 into an extended position. A clip 26 may be provided adjacent the first end 21*a* of the main body member 21 to limit the movement of the plunger 23 and prevent the plunger 23 from escaping the bore 22 of the main body member 21 in a pre-assembled state. A locking member 27 is employed to lock the plunger 23 in the extended position for normal activated operation of the valve lifter assembly. During normal operation, where the valve 5 is activated, the cam 3 causes the valve lifter assembly 1 together with the plunger 23 to move up and down in a reciprocating manner to engage the rocker arm 11 and reciprocatingly operate the valve 5. FIG. 1 shows the valve lifter assembly 1 and valve 5 in a closed position.

Figure 2:
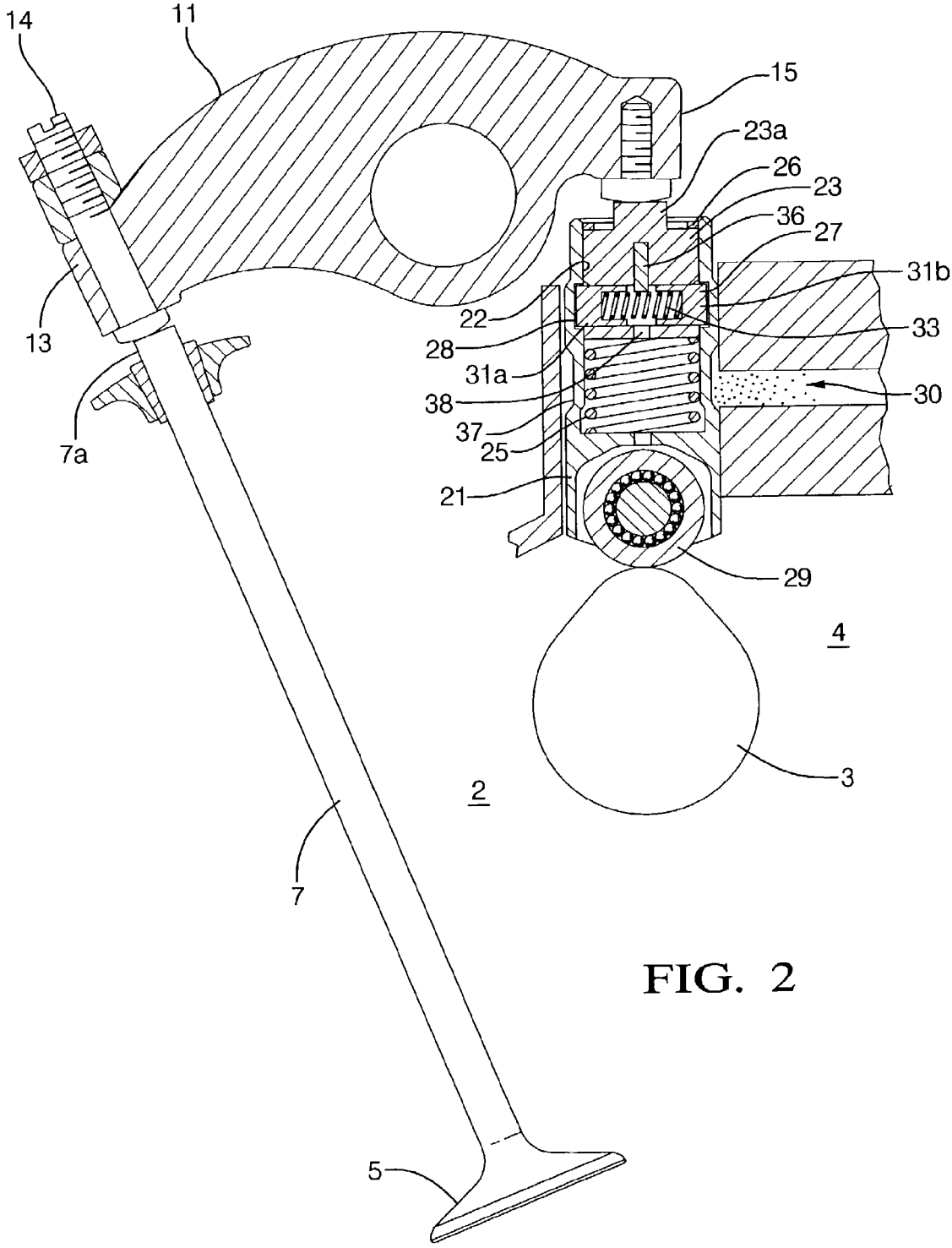
FIG. 2 is a sectional view of the over head cam valve train assembly in an internal engine employing the lifter shown in FIG. 1 during normal operation with the valve in the open position.

A roller 29 is rotatably mounted to a second end 21*b* of the main body member 21 of the valve lifter assembly 1 and engages a lower portion of the cam 3 to provide a rolling interface there between. The valve spring (not shown) biases the valve 5 and rocker arm 11 into a closed position. However, as the cam 3 rotates the valve lifter assembly 1 and plunger 23 are forced upward and the rocker arm 11 pivots and the valve 5 opens. FIG. 2 depicts the arrangement of FIG. 1 in an open position. The entire valve lifter assembly 1 together with the plunger 23 is urged in the upward most position as the roller 29 engages the highest portion of the cam 3. Consequently, the rocker arm 11 pivots counter clockwise and the valve stem 7 is forced downward to open the valve 5. As the cam 3 continues to rotate, the valve 5 is allowed to close by virtue of the biasing force of the valve spring (not shown).

Figure 3:
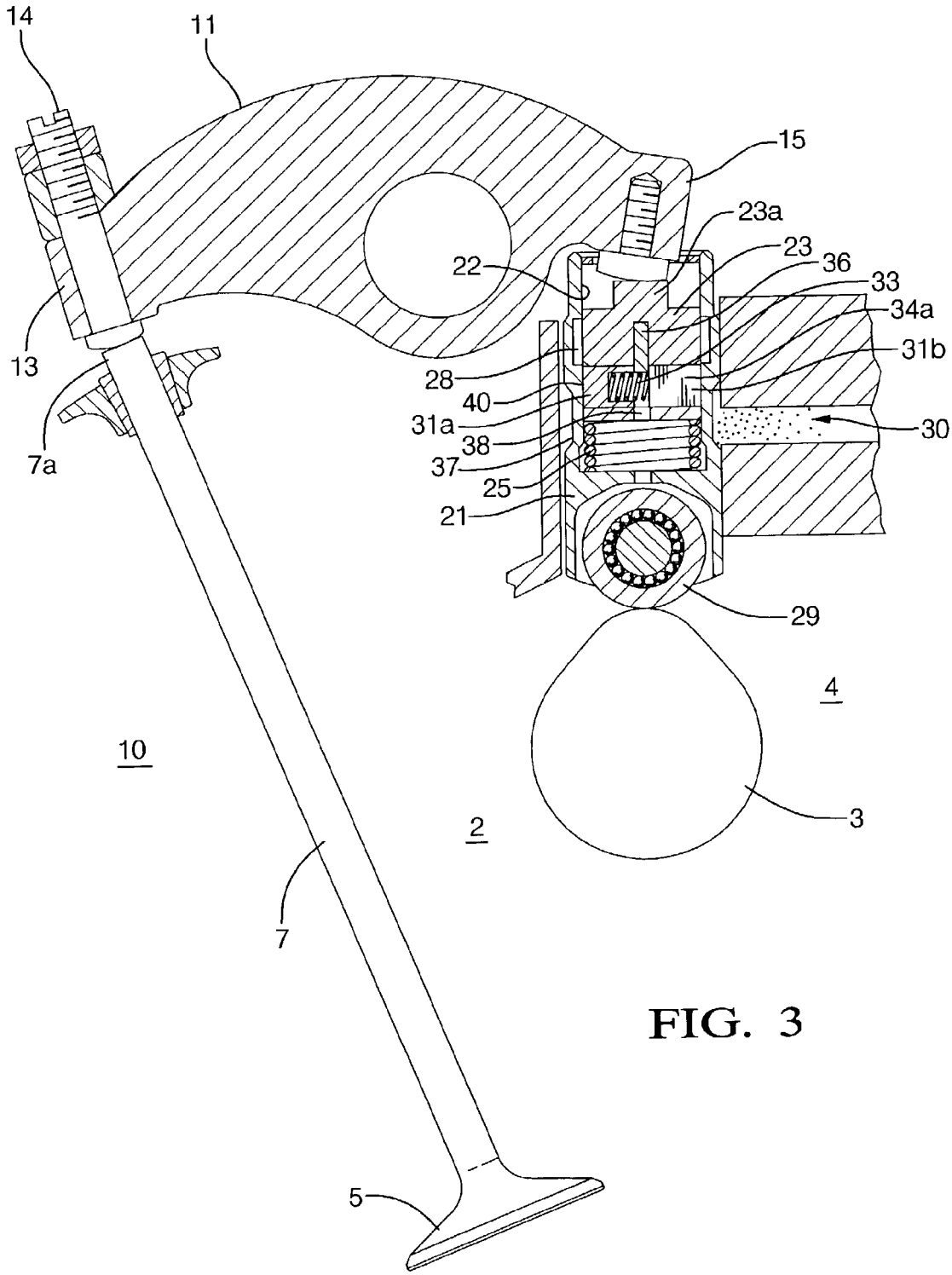
FIG. 3 is a sectional view of the over head cam valve train assembly in an internal engine employing the lifter shown in FIG. 2 during deactivation with the valve remaining in the closed position.

However, when the valve 5 is to be deactivated, the locking member 27 is released to allow the plunger 23 to recede within the bore 22 to take up the cam lift so that the valve 5 is not opened. As can be seen in FIG. 3, the roller 29 engages the cam 3 at its highest point. However, the rocker arm 11 and valve 5 remain in the closed position. Pressurized oil 30 is selectively supplied to the locking member 27 to release the plunger 23 and permit the plunger 23 to move deeper within the bore 22 of the main body member 21. As the cam 3 urges the main body member 21 upward, the plunger 23 remains substantially stationary relative to the head. The main body member 21 rides upward and the plunger 23 recesses further within the bore 22. The spring 25 biases the plunger 23 upward relative to the main body member 21 to engage the second end 15 of the rocker arm 11. Similarly, the spring 25 urges the main body member 21 and roller 29 downward to maintain constant contact with the cam 3. However, the force of the spring 25 is much less than the force of the valve spring (not shown) which urges the valve 5 and rocker arm 11 into the closed position.

In the embodiment shown, valve lifter assembly 1 replaces a hydraulic valve lifter, which otherwise would provide lash adjustment. As yet another alternative to providing a hydraulic lash adjuster between second end 15 of rocker arm 11 and plunger 23, a separate lash adjuster may be provided by a hydraulic element assembly on the valve side of the rocker arm between the rocker arm and the upper portion 7*a* of the valve stem. A mechanical adjustment means 14 as shown in each of the drawing figures may also be provided. Such a mechanical adjustment means 14 may be a simple member threadingly extending through the bore in the end of the rocker arm. In the embodiment employing a mechanical lash adjuster, there is no need for the clip 26. However, if a hydraulic lash element is employed, the clip 26 is required to define and control the uppermost position of plunger 23 and valve train lash resulting therefrom. In such an embodiment the spring 25 must be stronger than the hydraulic lash element to prevent the plunger 23 from collapsing within the main body member 21. Of course other means for adjusting lash may also be employed.

Figure 5:
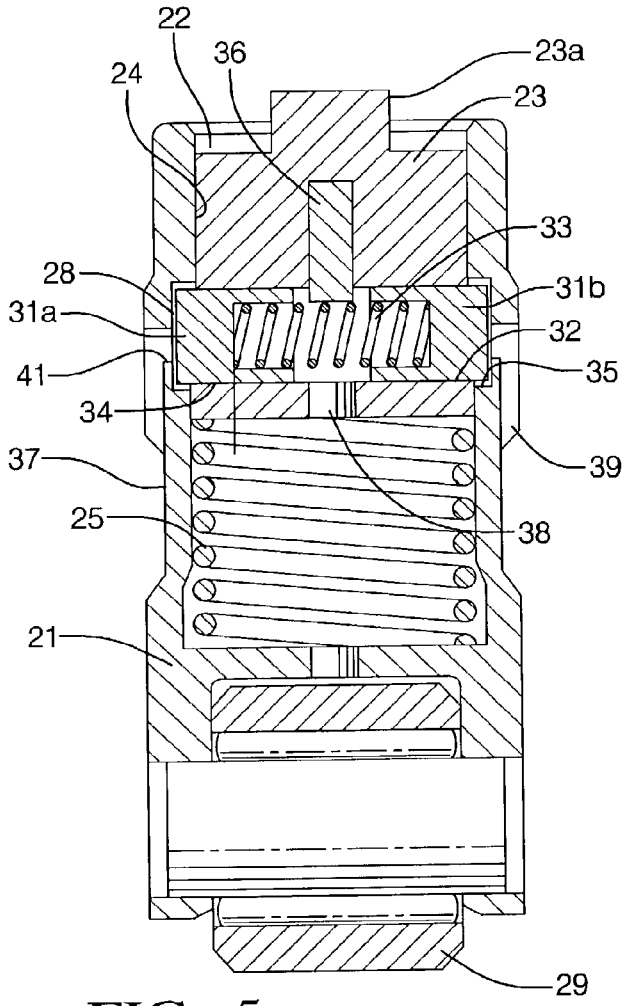
FIG. 5 is a sectional view of the valve lifter of the present invention taken along lines 5—5 of FIG. 4.

The specific operation of the locking member 27 between the plunger 23 and the main body member 21 of the valve lifter assembly 1 will now be explained. Referring to FIG. 5, as also may be seen in each of FIGS. 1–3, the plunger 23 has a pair of locking pins 31*a*, 31*b* slidingly disposed within a bore 32 extending through the plunger 23. A spring 33 is disposed between the locking pins 31*a*, 31*b* to bias the locking pins 31*a*, 31*b* outward. A stop 36 is also provided intermediate the locking pins 31*a*, 31*b* to ensure symmetrical displacement of the locking pins 31*a*, 31*b* during deactivation. In the locked position, the locking pins 31*a*, 31*b* engage an annular groove 28 or hole formed on the inner surface 24 of the bore 22 of the main body member 21 of the valve lifter assembly 1. In the locked position, the locking pins 31*a*, 31*b* retain the plunger 23 in the extended position so that the rotation of the cam 3 will open and close the valve 5 as previously described and shown in FIGS. 1–2. In the normal state, spring 25 biases the plunger 23 in the extended position and the spring 33 biases the locking pins 31*a*, 31*b* in the locked position. The locking pins 31*a*, 31*b* may be cylindrical pins disposed within a circular bore radially extending through the plunger 23 and into a corresponding bore in the main body member 21. In such an instance a means to prevent relative rotation of the plunger 23 with respect to the main body member 21 during deactivation must be provided. It is preferred, however, to employ square pins 31*a*, 31*b* which engage the main body member 21 within an annular groove 28 formed on the inner surface 24 of bore 22 to allow relative rotation of the plunger 23 with respect to the main body member 21. In the locked position as shown in FIGS. 1, 2, and 5, planar stop surface 34 of locking pins 31*a*, 31*b* engage parallel annular latch surface 35 of annular groove 28. The flatted cross-section of the square pins, including their flat side surfaces 34*a* (FIG. 3) disposed perpendicular to planar stop surface 34, are in close fitting but slidable engagement with the walls of plunger bore 32 to prevent rotation of the locking pins 31*a*,31*b* within plunger bore 32 so that planar stop surface 34 remains parallel to annular latch surface 35.

Figure 6:
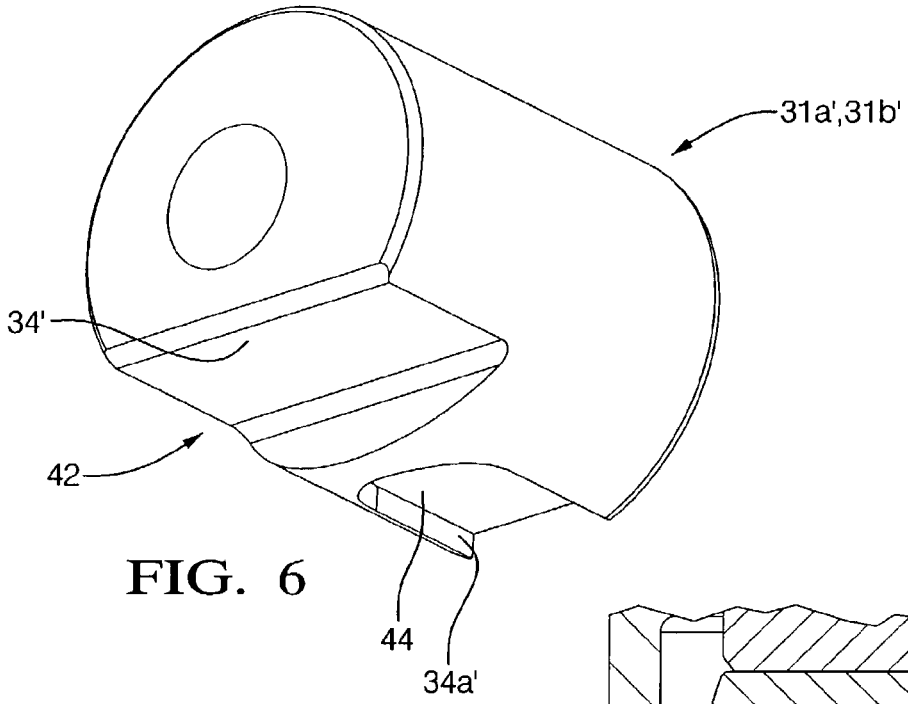
FIG. 6 is an isometric view of a cylindrical locking pin of the present invention.
Figure 7:
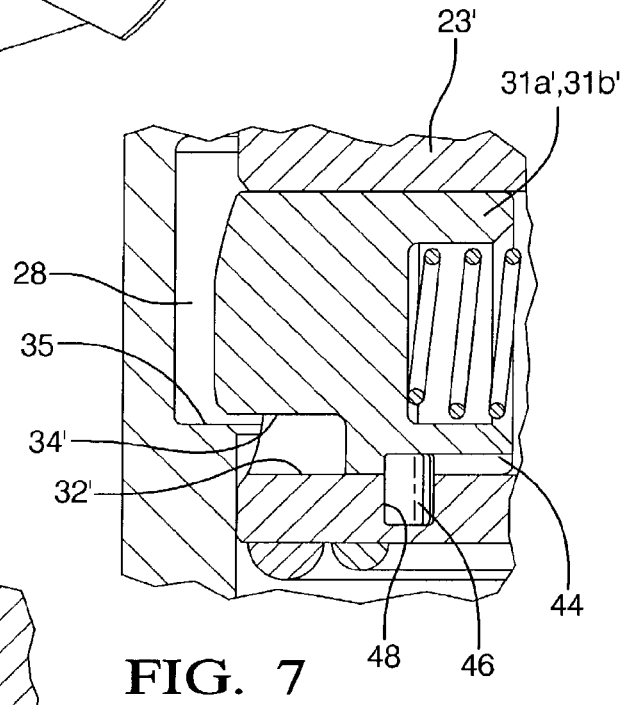
FIG. 7 is a sectional view of the locking pin shown in FIG. 6, assembled in the valve lifter of the present invention.
Figure 8:
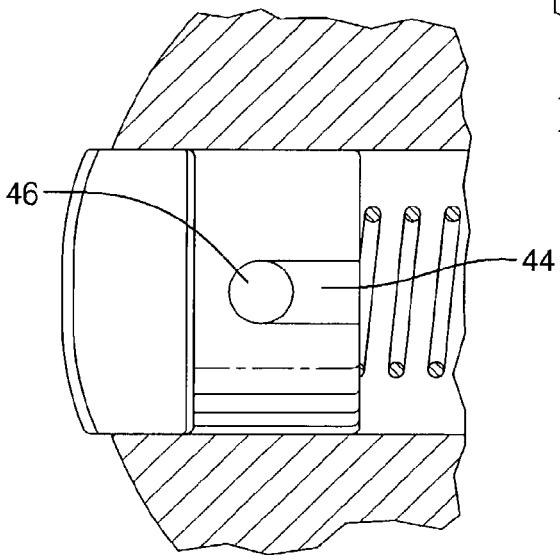
FIG. 8 is a bottom sectional view of the plunger shown in FIG. 7.

In an alternate embodiment (FIGS. 6–8), cylindrical locking pins 31*a*' and 31*b*' (only one shown for clarity) suitable for engagement with annular groove 28 are disclosed. Cylindrical locking pins 31*a*' and 31*b*' are disposed within circular bore 32' extending through plunger 23', similar to that described above. Cylindrical locking pins 31*a*',31*b*' further define stepped flats 42 that include planar stop surfaces 34' for engagement with annular latch surface 35 of annular groove 28. Cylindrical locking pins 31*a*',31*b*' further include elongate stop grooves 44 defining flatted surfaces 34*a*' disposed generally perpendicular to planar stop surfaces 34'. Stop pins 46 pressed in apertures 48 in plunger 23' extend a predetermined distance into circular bore 32' and into elongate stop grooves 44 and against flatted surfaces 34*a*' to prevent excessive rotation of cylindrical locking pins 31*a*', 31*b*' within circular bore 32' so that planar stop surfaces 34' remain substantially parallel to annular latch surface 35 of annular groove 28.

Figure 9:
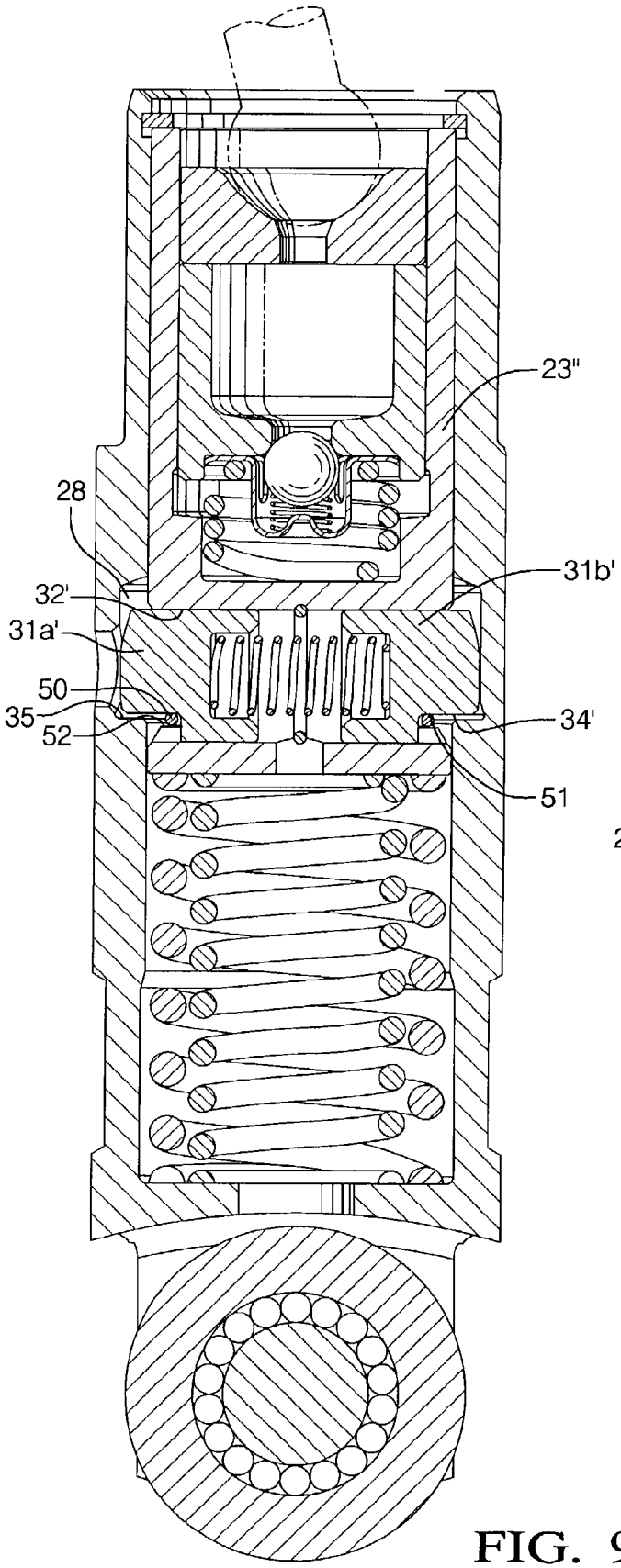
FIG. 9 is a sectional view of another valve lifter of the present invention showing the anti-rotation ring.

A further embodiment (FIG. 9) demonstrates a means for preventing excessive rotation of cylindrical locking pins 31*a*',31*b*'. Plunger 23" includes ant-rotation ring 50, disposed within circumferential groove 52 of plunger 23" adjacent cylindrical locking pins 31*a*',31*b*'. Anti-rotation ring 50 is generally C-shaped, and is disposed in close proximity to a ring stop surface 51 substantially parallel and preferably contiguous with planar stop surface 34'. Preferably, ring 50 is constructed of circular cross-section wire but can be of other cross-section construction including, for example, square.

Figure 10:
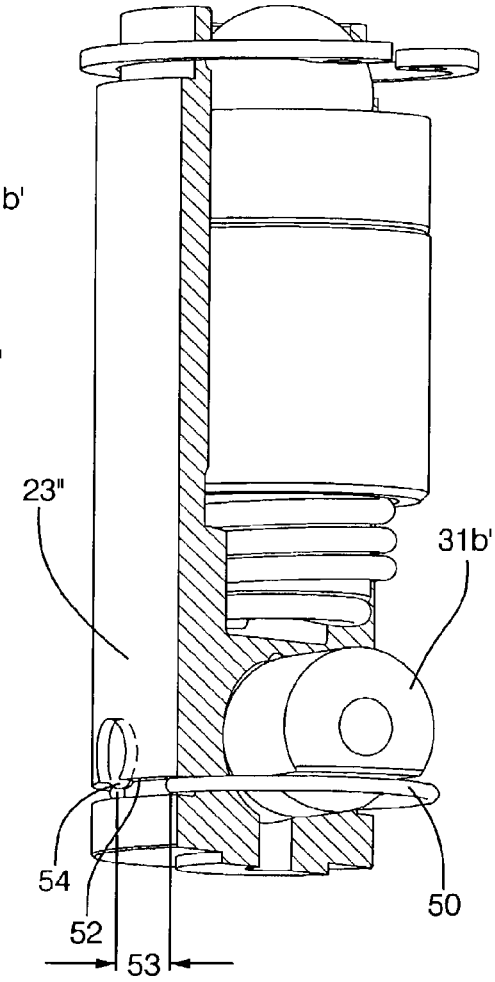
FIG. 10 is a partial sectional view of the plunger shown in FIG. 9 showing further detail of the anti-rotation ring.

The gap 53 (FIG. 10) in C-shaped ring 50, after the C-ring is installed, is oriented away from cylindrical locking pins 31*a*',31*b*' to avoid undesirable rotation of cylindrical locking pins 31*a*',31*b*'. Preferably, once oriented, anti-rotation ring 50 is held in place by a narrowed portion 54 of circumferential groove 52, or by upsetting a portion of groove 52 after ant-rotation ring 50 is installed. Thus, excessive rotation of cylindrical locking pins 31*a*',31*b*' within circular bore 32' is prevented so that planar stop surfaces 34' remain substantially parallel to annular latch surface 35 of annular groove 28. As described in this embodiment, cylindrical locking pins 31*a*',31*b*' would not need elongate stop groove 44 as a means for preventing rotation of pins 31*a*',31*b*'.

Referring again to FIG. 3, when deactivation is required, pressurized oil 30 is supplied to the outer ends 40 of the locking pins 31*a*, 31*b* to force the locking pins 31*a*, 31*b* inward overcoming the bias in the spring 33 to allow the plunger 23 to move within the bore 22 of the main body member 21 and isolate the cam lift. Routing of pressurized oil 30 to the exterior of the main body member 21 is provided in a similar fashion to the way in which oil is delivered to the outside surface of a tappet body of a conventional hydraulic lifter and will not be explained in great detail as such supply of oil is readily understood by one of ordinary skill in the art.

Figure 4:
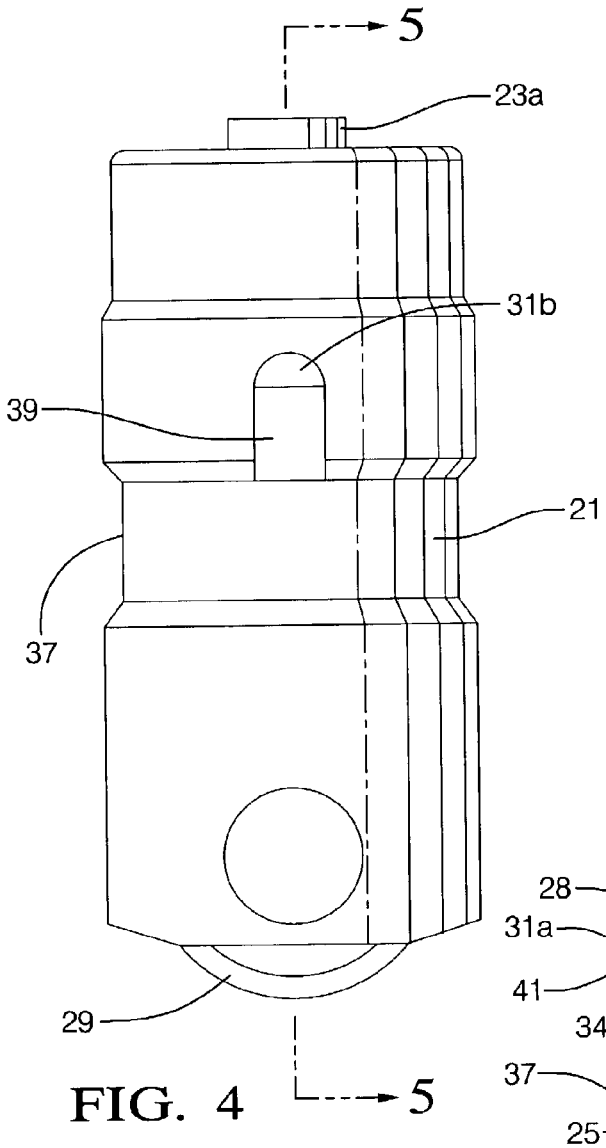
FIG. 4 is an isolated side view of the valve lifter of the present invention.

Referring now to FIG. 4, the main body member 21 of the valve lifter assembly 1 is provided with an external annular recess 37 to receive the supply of pressurized oil 30 much like conventional hydraulic lifters. A channel 39 is further formed on the side of the main body member 21 leading to one or more bores 41 (FIG. 5) extending through the main body member 21 to the annular groove 28 in which the locking pins 31*a*, 31*b* are disposed. The external annular recess 37, channel 39 and one or more bores 41 establish fluid communication between the pressurized oil 30 and the annular groove 28. When the oil 30 is pressurized to a sufficient level, the pressure builds up on the outer ends 40 of the locking pins 31*a*, 31*b* forcing the locking pins 31*a*, 31*b* inward unseating and disengaging the locking pins 31*a*, 31*b* from the annular groove 28 formed in the main body member 21. The plunger 23 is therefore free to move within the bore 22 of the main body member. Thus, as can be seen in FIG. 3, during deactivation, as the cam 3 rotates, the main body member 21 is forced upward and the plunger 23 is forced deeper within the main body 21 member to take up the cam lift and therefore prevent the rocker arm 11 from pivoting and the valve 5 from opening. When activation of the valve 5 is desired, the oil pressure is lowered and the spring 25 urges the plunger 23 upward and the spring 33 urges the locking pins 31*a*, 31*b* to engage the annular groove 28 during the cam down stroke. Thus the plunger 23 becomes locked in the extended position relative to the main body member 21 and normal operation of the valve 5 continues. Deactivation/activation of the valve 5 is then simply controlled by supplying and removing pressurized oil 30 to the valve lifter assembly 1 which may be controlled by a simple valve mechanism. (Not shown). However, the control of the pressurized oil supply is readily understood by one of ordinary skill in the art.

FIG. 5 depicts a sectional view of the valve lifter assembly 1 according to the present invention. An additional channel 39 may be provided, one each adjacent the locking pins 31*a*, 31*b*. Such an arrangement is particular beneficial in the embodiment utilizing cylindrical locking pins disposed within a bore formed in the main body member 21 of the valve lifter assembly as previously described. However, only a single channel 39 is required in the preferred annular groove and square pin arrangement. It is to be understood that the present invention is not limited to the specific number of channels 39.

A vent 38 (FIG. 5) is also provided within the plunger between the locking pins 31*a*, 31*b* to provide an escape of any oil trapped there between. The vent 38 directs any oil though the main body member 21 and onto the roller 29 which serves the additional benefit of providing additional lubrication.

While the present invention has been shown and described with reference to specific embodiments forming the best mode, various changes in form and detail may be made without departing from the spirit and scope of the invention. While the best modes for carrying out the invention have been described in detail, those familiar with the art to which this invention relates will recognize various alternatives, designs and embodiments for practicing the present invention as defined by the following claims. For example, the above-described preferred embodiment has been shown in a cam in head arrangement. However, the instant invention may be employed in lower cam pushrod engines, the details of which need not be shown or demonstrated and will be equally appreciated by one of ordinary skill in the art. In such an instance the lifter assembly would be disposed between the cam and pushrod leading to the rocker arm as opposed to directly engaging the rocker arm.

What is claimed is:

1. A valve lifter assembly for deactivating a cylinder valve in an internal combustion engine, said lifter assembly comprising:

a main body member adapted to be disposed between said valve and a cam of said internal combustion engine to transmit rotational movement of said cam to reciprocatingly operate said valve;

a plunger movably disposed within a bore of said main body member to facilitate a varying overall length of said lifter assembly;

a first spring disposed between said plunger and said main body member to bias said plunger in said extended position;

a selectively movable locking member disposed between said main body member and said plunger and movable between a locked position and an unlocked position to selectively secure said plunger to said main body member, wherein said locking member comprises at least one locking pin movably disposed within a second bore extending within said plunger and adapted to engage an annular groove formed on an inner surface of said bore of said main body member and having a second spring to bias said at least one locking pin to engage said annular groove;

wherein when said locking member is in said locked position said plunger is secured to said main body member in an extended position to prevent relative movement there between and thereby transmit said rotational movement of said cam to operate said valve, and when said locking member is in said unlocked position said plunger is permitted to move relative to said main body member to reduce said overall length of said lifter assembly and provide a clearance to isolate said rotational movement of said cam to deactivate said valve.

2. A valve lifter assembly for deactivating a cylinder valve in an internal combustion engine, said lifter assembly comprising:

a main body member adapted to be disposed between said valve and a cam of said internal combustion engine to transmit rotational movement of said cam to reciprocatingly operate said valve;

a plunger movably disposed within a bore of said main body member to facilitate a varying overall length of said lifter assembly, wherein said plunger is disposed within said bore of said main body member extending from a first end thereof and having an exposed surface adjacent thereto adapted to engage a rocker arm disposed between said lifter assembly and said valve;

a roller rotatably secured to a second end of said main body member to provide a rolling interface between said cam and said lifter assembly;

a selectively movable locking member disposed between said main body member and said plunger and movable between a locked position and an unlocked position to selectively secure said plunger to said main body member;

wherein when said locking member is in said locked position said plunger is secured to said main body member in an extended position to prevent relative movement there between and thereby transmit said rotational movement of said cam to operate said valve, and when said locking member is in said unlocked position said plunger is permitted to move relative to said main body member to reduce said overall length of said lifter assembly and provide a clearance to isolate said rotational movement of said cam to deactivate said valve.

3. The lifter assembly according to claim 1, wherein said at least one locking pin includes a pair of locking pins disposed within said second bore extending through said plunger, said second spring being disposed between said pair of locking pins to outwardly bias said pair of locking pins to engage opposite portions of said annular groove.

4. The lifter assembly according to claim 3, further comprising a source of pressurized oil in selective communication with outward most ends of said pair of locking pins to selectively force said pair of locking pins inward to disengage said annular groove and allow said plunger to move relative to said main body member of said lifter assembly.

5. The lifter assembly according to claim 4, wherein said main body member has an external annular recess in communication with a longitudinally extending channel leading to at least one bore that in turn is in communication with said annular groove to thereby establish said communication of said pressurized oil to said pair of locking pins.

6. The lifter assembly according to claim 3, said plunger further comprising a stop provided intermediate said pair of locking pins, said stop preventing excessive displacement of both said pair of locking pins to enhance symmetrical displacement within said second bore.

7. The valve lifter according to claim 4, wherein said plunger further comprising a vent disposed between said pair of locking pins to provide an escape for oil trapped there between.

8. A valve lifter assembly in combination with an overhead camshaft driven valve assembly of an internal combustion engine, said combination comprising:

a valve for opening and closing a port of a cylinder of said internal combustion engine, said valve having a valve stem extending therefrom;

a rocker arm pivotally secured to a portion of said internal combustion engine and having a first end engaging an end of said valve stem and a second end adapted to engage said valve lifter assembly;

a rotatable cam driven by said overhead camshaft; and said valve lifter assembly disposed between said second end of said rocker arm and said cam to transmit cam lift to said rocker arm and thereby reciprocatingly operate said valve, said lifter assembly comprising;

a main body member disposed between said valve and said cam;

a plunger movably disposed within a bore of said main body member extending from a first end thereof and having an exposed surface adjacent thereto adapted to engage said second end of said rocker arm to facilitate a varying overall length of said lifter assembly;

a first spring disposed between said plunger and said main body member to bias said plunger in an extended position;

a roller rotatably secured to a second end of said main body member to provide a rolling interface between said cam and said lifter assembly;

a selectively movable locking member disposed between said main body member and said plunger and movable between a locked position and an unlocked position to selectively secure said plunger to said main body member, said locking member including a pair of locking pins disposed within a second bore extending through said plunger and a second spring being disposed between said pair of locking pins to outwardly bias said pair of locking pins to engage an annular groove formed in said bore of said main body member; and a source of pressurized oil in selective communication with outer ends of said pair of locking pins to selectively force said pair of locking pins inward to disengage said annular groove and allow said plunger to move relative to said main body member of said lifter assembly;

wherein when said locking member is in said locked position said plunger is secured to said main body member in said extended position to prevent relative movement there between and thereby transmit said cam lift to said rocker arm to thereby operate said valve, and when said locking member is in said unlocked position said plunger is permitted to move relative to said main body member to absorb said cam lift and prevent rotation of said rocker arm and thereby deactivate said valve.

* * * * *